US009129740B2

(12) United States Patent
Stegmaier

(10) Patent No.: US 9,129,740 B2
(45) Date of Patent: Sep. 8, 2015

(54) IGNITION COIL HAVING INTEGRATED ELECTRONICS

(75) Inventor: Alwin Stegmaier, Blaichach (DE)

(73) Assignee: ROBERT BOSCH GMBH, Stuttgart (DE)

( * ) Notice: Subject to any disclaimer, the term of this patent is extended or adjusted under 35 U.S.C. 154(b) by 69 days.

(21) Appl. No.: 13/991,228

(22) PCT Filed: Sep. 29, 2011

(86) PCT No.: PCT/EP2011/067040

§ 371 (c)(1),
(2), (4) Date: Aug. 14, 2013

(87) PCT Pub. No.: WO2012/072312

PCT Pub. Date: Jun. 7, 2012

(65) Prior Publication Data

US 2013/0321975 A1 Dec. 5, 2013

(30) Foreign Application Priority Data

Dec. 2, 2010 (DE) ..... 10 2010 062 349

(51) Int. Cl.

| | |
|---|---|
| ***F23Q 3/00*** | (2006.01) |
| ***H01F 38/12*** | (2006.01) |
| ***H01F 27/02*** | (2006.01) |
| *F02P 3/04* | (2006.01) |
| *H01F 27/40* | (2006.01) |

(52) U.S. Cl.

CPC ..... *H01F 38/12* (2013.01); *H01F 27/022* (2013.01); *F02P 3/0435* (2013.01); *H01F 27/40* (2013.01)

(58) Field of Classification Search

CPC ..... F02P 3/00; F02P 3/055; F02P 3/04
USPC ..... 361/263; 123/634
See application file for complete search history.

(56) References Cited

U.S. PATENT DOCUMENTS

| | | | | |
|---|---|---|---|---|
| 5,044,328 | A * | 9/1991 | Umezaki | 123/647 |
| 5,558,074 | A * | 9/1996 | Fukatsu et al. | 123/647 |
| 5,740,787 | A * | 4/1998 | Ando | 123/635 |

(Continued)

FOREIGN PATENT DOCUMENTS

| | | |
|---|---|---|
| DE | 39 22 267 | 2/1990 |
| EP | 1 065 916 | 1/2001 |

(Continued)

OTHER PUBLICATIONS

"Dielectric Strength". Wikipedia. Aug. 22, 2014. <http://en.wikipedia.org/wiki/Dielectric_strength>.*

(Continued)

*Primary Examiner* — Thienvu Tran
*Assistant Examiner* — Christopher Clark
(74) *Attorney, Agent, or Firm* — Kenyon & Kenyon LLP

(57) ABSTRACT

An ignition coil, in particular for an internal combustion engine in a vehicle, is described. The ignition coil includes a housing, a primary winding and a secondary winding, and an electronic component, a highly heat-conducting, electrically insulating, elastic heat-conducting element, which is situated between the electronic component and the housing, and a thermally and electrically insulating casting compound, which is introduced into the housing in order to fill interspaces in the housing, the heat-conducting element touching the electronic component.

12 Claims, 1 Drawing Sheet

(56) References Cited

U.S. PATENT DOCUMENTS

| | | | | |
|---|---|---|---|---|
| 5,778,863 | A * | 7/1998 | Oosuka et al. | 123/634 |
| 5,870,012 | A * | 2/1999 | Sakamaki et al. | 336/107 |
| 6,545,581 | B1 * | 4/2003 | Munsch et al. | 336/90 |
| 2003/0192519 | A1 * | 10/2003 | Katayama et al. | 123/634 |
| 2003/0222743 | A1 * | 12/2003 | Kondo et al. | 336/90 |
| 2004/0011342 | A1 * | 1/2004 | Fukatsu | 123/630 |
| 2005/0056918 | A1 * | 3/2005 | Jeun et al. | 257/678 |
| 2006/0006517 | A1 * | 1/2006 | Lee et al. | 257/686 |
| 2006/0201475 | A1 * | 9/2006 | Shiraishi | 123/299 |
| 2007/0145023 | A1 * | 6/2007 | Holber et al. | 219/121.52 |
| 2008/0149166 | A1 * | 6/2008 | Beeson et al. | 136/248 |
| 2008/0282542 | A1 * | 11/2008 | McCutcheon et al. | 29/890.039 |
| 2011/0006664 | A1 * | 1/2011 | Hamaguchi et al. | 313/358 |

FOREIGN PATENT DOCUMENTS

| | | |
|---|---|---|
| JP | 08 144 919 | 6/1996 |
| WO | WO 2010/103852 | 9/2010 |

OTHER PUBLICATIONS

International Search Report, International Application No. PCT/EP2011/067040, dated Jan. 9, 2012.

* cited by examiner

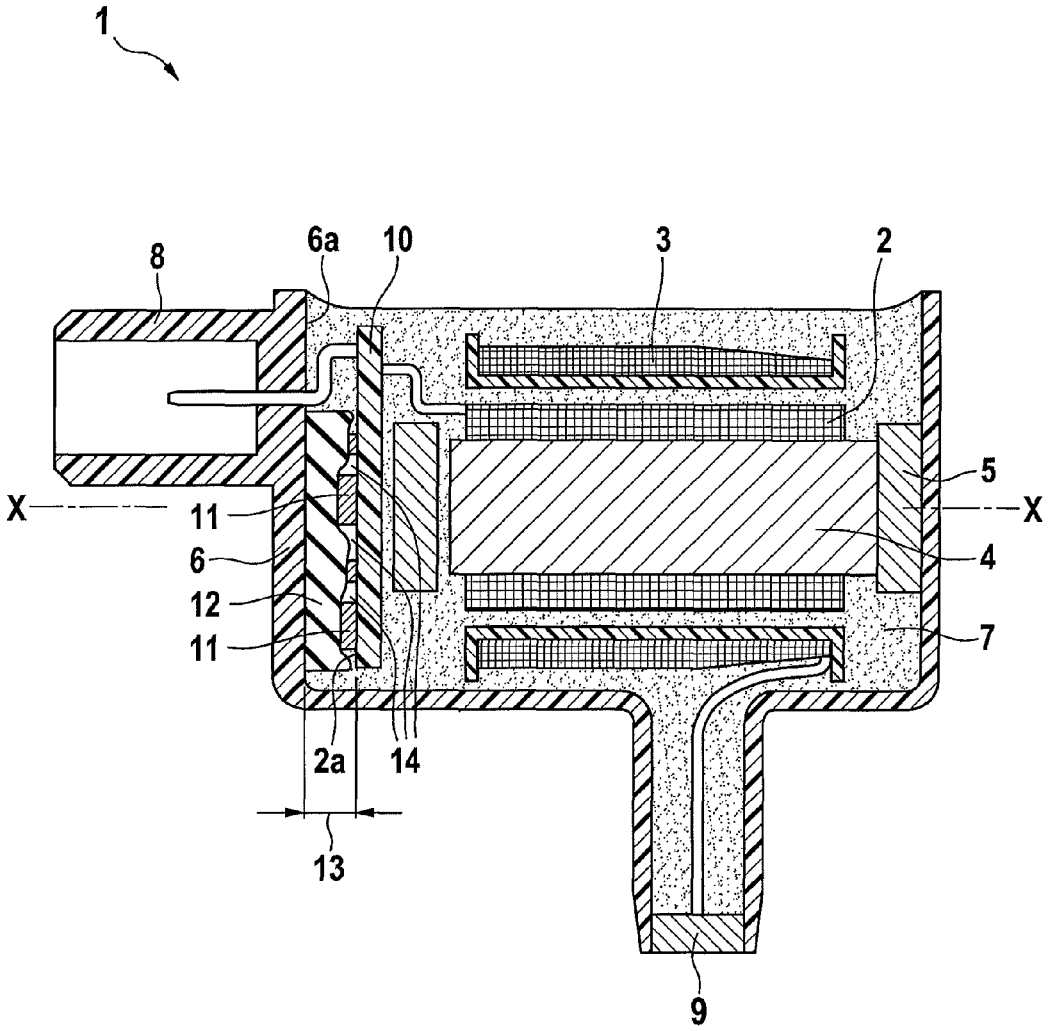
1
8
6a
10
3
2
5
X
X
11
6
12
11
4
7
2a
14
13
9

IGNITION COIL HAVING INTEGRATED ELECTRONICS

FIELD

The present invention relates to an ignition coil, in particular for internal combustion engines of vehicles, having integrated electronics.

BACKGROUND INFORMATION

Conventional ignition coils are of various designs. An electronics system for actuating the ignition coils is typically disposed in a central control unit of a vehicle. However, since vehicles have an ever increasing number of electronic devices, space problems and problems related to excessive heating of the control units arise for the control units. The functionality of the electronics system also continues to increase. As a result, an integration of control elements into the ignition coil is under consideration. However, the integration of a circuit board into an ignition coil results in the following problems: Since the interspaces of the ignition coil are filled with cast resin, which is a very poor thermal conductor, considerable heating of components of the circuit board or of the circuit board itself comes about. This can cause damage to the electronics components. Moreover, intrinsic stresses of the cast resin due to shrinkage during the curing process have a detrimental effect on the electronics components, so that tears could form and the electronic components sustain damage.

SUMMARY

An example ignition coil according to the present invention may have the advantage that an electronics component is integrated into the ignition coil and no thermal damage of the electronics component occurs. Neither is there any detrimental effect on the electronics component due to shrinkage during a curing process of a casting material. The ignition coil according to the present invention thus has a considerable longer service life. In accordance with the present invention, this is achieved in that the example ignition coil has a housing as well as a heat-conducting element which has high thermal conductivity, electrically insulating properties and elastic properties. The heat-conducting element is situated between an electronics component and the housing. This means that the heat-conducting element covers the electronics component, which enables it to shunt heat from electronics component in very satisfactory manner. In addition, the heat-conducting element prevents that a casting compound is cast over the electronics component and cures there, which may lead to undesired damage to the electronics component. Despite the integration of the electronics component, the example ignition coil according to the present invention has a very compact design.

In an especially preferred embodiment, the heat-conducting element includes silicon and heat-conducting ceramic material, which is embedded in the silicon. The silicon assumes the elastic properties, and the ceramic material assumes the heat-conducting properties. Both materials are also electrically non-conductive. As an alternative, the heat-conducting element includes an elastic plastic and a heat-conductive, electrically non-conductive filler material, possibly a ceramic material again.

It is especially preferred if the electronics component is a circuit board carrying at least one electronic component, and the heat-conducting element touches the circuit board and/or the electronic component. This provides excellent heat dissipation.

It is especially preferred if the heat-conducting element is a foil. This simplifies the handling of the heat-conducting element, in particular.

According to one further preferred embodiment of the present invention, the heat-conducting element is attached to the electronics component, preferably by an adhesive connection. If the electronics component is developed as circuit board having at least one electronic component, then the heat-conducting element may be fixed in place on the circuit board and/or the electronic component.

To provide especially good heat dissipation, the heat-conducting element preferably is situated directly on a housing inside and touches the housing inside.

In an especially preferred manner, the electronic component implemented as circuit board having electronic components is disposed perpendicularly to an axial direction of the ignition coil in order to allow a compact design.

In furthermore preferred manner, the ignition coil includes an electrical connection and the electronics component is situated between the electrical connection and a primary winding of the ignition coil. This, too, results in an especially compact design.

To provide especially satisfactory heat dissipation, the electronic components preferably are situated on only one side of the circuit board. In this way it suffices if the heat-conducting element is situated on only one side of the circuit board.

It is furthermore preferred if the thermal conductivity of the heat-conducting element is greater than or equal to 2 W/mK, preferably greater than or equal to 5 W/mK, and it is furthermore preferred if a dielectric strength of the heat-conducting element is greater than or equal to 1000 V/mm, especially preferably greater than or equal to 3000 V/mm.

The ignition coil according to the present invention is especially preferably used in internal combustion engines of vehicles.

BRIEF DESCRIPTION OF THE DRAWING

A preferred exemplary embodiment of the present invention is described in detail below, with reference to the figure.

FIG. 1 shows a schematic sectional view of an ignition coil according to an exemplary embodiment of the present invention.

DETAILED DESCRIPTION OF EXAMPLE EMBODIMENTS

An ignition coil 1 is described in detail below, with reference to FIG. 1. Ignition coil 1 includes a primary winding 2, a secondary winding 3, an inner core 4 and an outer core 5. In addition, the ignition coil includes a housing 6, in which the cores and windings are accommodated. Interspaces in housing 6 are filled by a casting compound 7, such as cast resin. Moreover, an electric plug connection 8 and a high-voltage connection 9 are provided on housing 6.

Ignition coil 1 additionally includes as electronic component a circuit board 10, on which a multitude of electronic components 11 is situated. As can be gathered from FIG. 1, electronic components 11 are all located on one side of the circuit board. Circuit board 10, as illustrated in FIG. 1, is connected to electrical connection 8 on one side and to primary winding 2 on the other. Furthermore, ignition coil 1 includes a heat-conducting element 12, which is situated between an inside 6*a* of housing 6 and circuit board 10. Heat-conducting element 12 not only has high heat-conducting properties, but also electrically insulating characteristics as well as elastic characteristics. For example, heat-conducting element 12 includes silicon as base material, with embedded heat-conducting ceramics. Heat-conducting element 12 has a flat form, preferably implemented as a foil, and is bonded to electronic components 11 by means of an adhesive agent. As can be gathered from FIG. 1, heat-conducting element 12 is situated in such a way that it is slightly depressed in the region of the electronic components, so that a space 13 between a circuit board side 2*a*, on which the electronic components are fixed in place, and inside 6*a* of housing 6 lies in a range of 1.5 mm to 4 mm.

Circuit board 10 is situated perpendicularly to a center axis X-X of ignition coil 1. Primary winding 2 and secondary winding 3 are placed coaxially in relation to center axis X-X.

A size of heat-conducting element 12 is selected in such a way that all electronic components 11 are covered by heat-conducting element 12. It should be noted that an especially uncomplicated and rapid assembly is achieved if heat-conducting element 12 first is placed and fixated on circuit board 10 and/or electronic components 11, and the intermediate component produced in this manner then is inserted into housing 6. A fixation of the intermediate component may be accomplished via the electrical lines to electric connection 8 and to primary winding 2. As an alternative or in addition, it would also be possible to fix heat-conducting element 12 in place on inside 6*a* of housing 6, for instance by bonding. In the next step, casting compound 7 is introduced and cured. Since electronic components 11 are all placed on one side of circuit board 10 in this exemplary embodiment, there is no risk that electronic components 11 will be damaged because of shrinking casting compound during the curing process. Possibly arising forces may be absorbed by elastic heat-conducting element 12, which may deform itself in the process. It is therefore avoided that the electronic components and/or the circuit board are/is damaged during the production process.

In addition, it is possible to achieve markedly improved heat dissipation from electronic components 11 when using heat-conducting element 12 according to the present invention. Since heat-conducting element 12 is situated directly on housing 6 and is in contact with housing 6, the heat is able to be transferred to the housing and from there, to the environment. This enables an effective heat dissipation on circuit board 10, so that no thermal damage of the circuit board and/or electronic components 11 is able to occur.

It should be noted that, for example, line components such as four-layer semiconductor components (IGBT), circuit chips (ASIC) or a protective circuit for electromagnetic compatibility, are considered electronic components. According to the present invention, casting compound 7, which is a very poor heat conductor due to the electrical isolation of the high voltage in the ignition coil, no longer hampers the heat dissipation on the circuit board or the electronic components situated thereon. Therefore, the present invention makes it possible to realize a cost-effective integration of an electronic component into the ignition coil.

Heat-conducting element 12 thus is flexible and compressible, and may be depressed at the positions at which electronic components 11 are placed on circuit board 10 (see FIG. 1).

It should be noted that heat-conducting element 12 is capable not only of partially covering the circuit board as shown in FIG. 1, but also of covering it entirely, or it may be disposed only above individual or multiple electronic components 11, especially hot electronic components 11. However, a flat extension of heat-conducting element 12 is preferred, since heat is able to be dissipated in more optimal manner in this way. In addition, this also protects interspaces 14 between individual electronic components 11 prior to filling them with casting compound 7. Furthermore, elastic heat-conducting element 12 also makes it possible to reduce mechanical tensions that may arise in casting compound 7 during curing. Another advantage of heat-conducting element 12 is a possible compensation of geometrical tolerances of the circuit board or electronic components 11.

What is claimed is:

1. An ignition coil for an internal combustion engine in a vehicle, comprising:

a housing;

a primary winding and a secondary winding;

a circuit board carrying at least one electronic component;

a highly heat-conducting, electrically insulating, elastic element situated between the electronic component and the housing, the heat-conducting element touching the electronic component; and a thermally and electrically insulating casting compound, which fills interspaces inside the housing.

2. The ignition coil as recited in claim 1, wherein the heat-conducting element includes one of: i) silicon and a heat-conductive ceramic material, or ii) an elastic plastic material and a heat-conductive, electrically insulating filler material.

3. The ignition coil as recited in claim 1, wherein the heat-conducting element is a flexible foil.

4. The ignition coil as recited in claim 1, wherein the heat-conducting element is fixed in place on the electronic component using an adhesive connection.

5. The ignition coil as recited in claim 1, wherein the heat-conducting element contacts an inside of the housing.

6. The ignition coil as recited in claim 1, wherein the circuit board is situated perpendicularly to an axial direction of the ignition coil.

7. The ignition coil as recited in claim 1, further comprising:

an electrical connection, the circuit board being situated between the electrical connection and the primary winding.

8. The ignition coil as recited in claim 1, wherein the electronic components are situated on only one side of the circuit board.

9. The ignition coil as recited in claim 1, wherein the heat-conducting element has a thermal conductivity of more than or equal to 2 W/mk.

10. The ignition coil as recited in claim 1, wherein the heat-conducting element has a thermal conductivity of more than or equal to 5 W/mk.

11. The ignition coil as recited in claim 1, wherein the heat-conducting element has a dielectric strength of more than or equal to 1000 V/mm.

12. The ignition coil as recited in claim 1, wherein the heat-conducting element has a dielectric strength of more than or equal to 3000 V/mm.

* * * * *